United States Patent [19]

Renzi

[11] Patent Number: 4,592,267

[45] Date of Patent: Jun. 3, 1986

[54] PRESSURIZED FLUID OPERATED CYLINDER

[75] Inventor: Ferdinando G. Renzi, Padova, Italy

[73] Assignee: Fizner Automazione di Renzi Ferdinando G., Padova, Italy

[21] Appl. No.: 595,890

[22] Filed: Apr. 2, 1984

[30] Foreign Application Priority Data

Apr. 15, 1983 [IT] Italy ..... 41551 A/83

[51] Int. Cl.[4] ..... F01B 29/00

[52] U.S. Cl. ..... 92/128; 92/164; 92/169

[58] Field of Search ..... 92/164, 169 R, 13.6, 92/59, 128

[56] References Cited

U.S. PATENT DOCUMENTS

| | | | |
|---|---|---|---|
| 2,480,633 | 8/1949 | Christensen | 92/164 |
| 2,518,787 | 8/1950 | Huhtala | 92/164 |
| 2,973,744 | 3/1961 | Hennells | 92/164 |
| 3,113,490 | 12/1963 | Weaver | 92/164 |
| 3,185,043 | 5/1965 | Dunham | 92/164 |
| 3,219,059 | 11/1965 | Williams et al. | 92/164 |

*Primary Examiner*—Robert E. Garrett
*Assistant Examiner*—Mark A. Williamson
*Attorney, Agent, or Firm*—Guido Modiano; Albert Josif

[57] ABSTRACT

The cylinder includes a cylindrical body and two heads made rigid therewith by means of connection rings interposed between the cylindrical body and a cylindrical member rigid with the heads and extending inside and parallel to the cylindrical body. The rings abut against mechanical retainers rigid with the cylindrical body and threadably engage the heads. Fluid-tight sealing is provided by O-ring seals.

7 Claims, 2 Drawing Figures

PRESSURIZED FLUID OPERATED CYLINDER

BACKGROUND OF THE INVENTION

This invention relates to a pressurized fluid operated cylinder.

Pressurized fluid operated cylinders conventionally comprise a cylindrical body and two heads which must be associated with said body to also provide a fluid tight seal under pressure.

In many prior approaches, the heads are interconnected by means of a number of threaded tie rods which allow said heads to be drawn together against said cylindrical body.

In some other prior approaches, the heads are threaded directly into the cylindrical body.

In either cases, quite a few difficulties are experienced which are connected with the large overall dimensions of the cylinder creating not negligible problems during the assembling stage.

Further problems are posed by the seals between the heads and cylindrical body, which should in no case allow fluid to seep out.

SUMMARY OF THE INVENTION

It is an object of this invention to provide an improved cylinder which is of very compact size.

Another object of the invention is to provide a cylinder which is made up of simple and readily assembled parts.

A further object is to provide a cylinder which incorporates highly safe and reliable seals.

A not unimportant object is to provide a cylinder of good quality and low cost.

These and other objects, such as will be apparent hereinafter, are achieved by a pressurized fluid operated cylinder, comprising a cylindrical body and two heads, characterized in that it comprises two rings interposed each between said cylindrical body and a respective head and said rings, in use, being connected internally to said respective one of said heads and externally to said cylindrical body by means of mechanical means, elastic means being interposed both between each of said rings and heads and between each of said rings and said cylindrical body, said elastic means forming fluid tight seals.

BRIEF DESCRIPTION OF THE DRAWINGS

Further features and advantages of the invention will be more clearly understood from the following detailed description of two preferred embodiments thereof, given herein by way of example and not of limitation with reference to the accompanying drawings, where.

DESCRIPTION OF THE PREFERRED EMBODIMENTS

Figure 1:
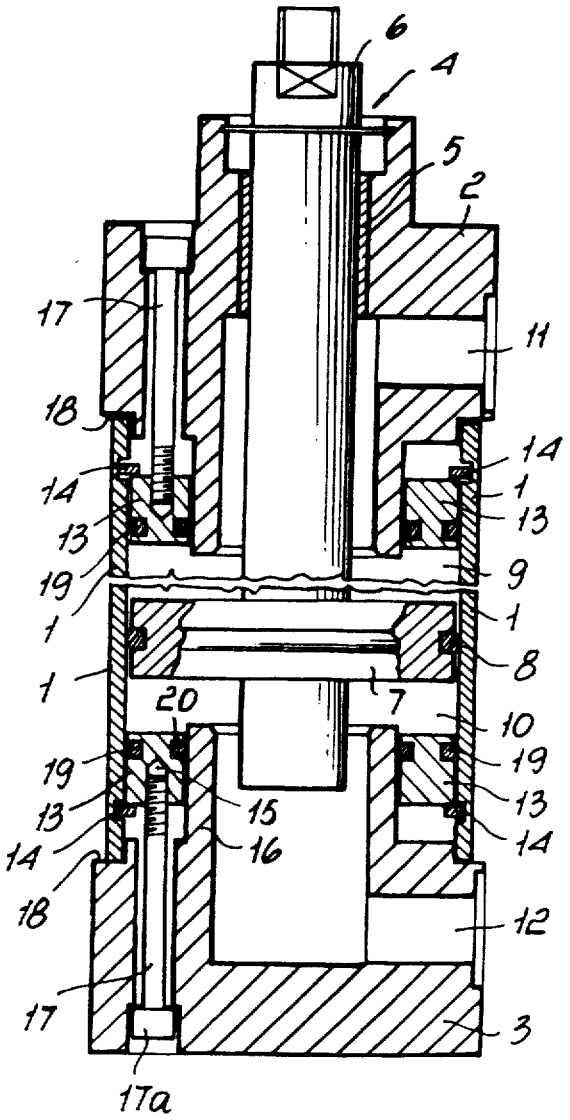
FIG. 1 is a midsectional view of a first embodiment of the invention.

Making reference to the drawing views, in a first embodiment of the invention shown in FIG. 1, this cylinder comprises a cylindrical body, for example formed from a length of ground tube, and two heads or end caps which are identified, for convenience sake, as an upper end cap 2 and lower end cap 3.

The upper end cap 2 has an axial bore 4 provided with a seal 5, wherethrough a rod 6 of a piston 7 is slidably passed which piston forms a seal with the inner wall of the cylindrical body 1 by means of an O-ring 8.

The piston 7 defines, inside the cylindrical body 1, two chambers, an upper one 9 and lower one 10, respectively, which are communicated, through the respective end caps, to upper 11 and lower 12 fluid passages wherethrough the connection to an oil or gas source is established.

In the embodiment shown in FIG. 1, the heads 2,3 are connected to the cylindrical body 1 in the same way, as it will be described below.

In actual practice, a rectangular cross-section ring 13 is provided which is locked within the cylindrical body 1 by a mechanical retainer 14 partly inserted in an annular groove formed in the inside surface of the cylindrical body 1 and projecting inwardly therefrom.

The ring 13 has a plurality of threaded, nonthroughgoing, holes 15 extending with their axes parallel to the centerline of the cylindrical body 1.

The lower end cap 3, whereto this description refers, is rigidly connected with an inner hollow cylindrical body 16 extending parallel to the cylindrical body 1 and having an outer diameter dimension which leaves an annular space from the cylindrical body 1, said space being occupied by the ring 13.

Plural throughgoing screws 17, threaded through the holes 15 in the ring 13, pull the cylindrical body 1 against an abutment 18 on the end cap 3, thus causing the ring 13 to act on the mechanical retainer 14.

A reliable and firm connection can be established, therefore, between the end cap 3 and cylindrical body 1.

To also provide a fluid tight seal, the ring 13 has an external annular groove with an O-ring 19 facing the cylindrical body 1, and an additional inner annular groove with an O-ring seal 20 facing the element 16.

Said seal and connection are duplicated for the upper end cap 2, where equivalent parts have been designated with the same reference numerals.

It may be appreciated from the foregoing that this cylinder is especially simple construction-wise, as simple are the assembly and disassembly procedures therefor.

Nothing stands outside because all the component parts are contained within the cylinder outline.

Figure 2:
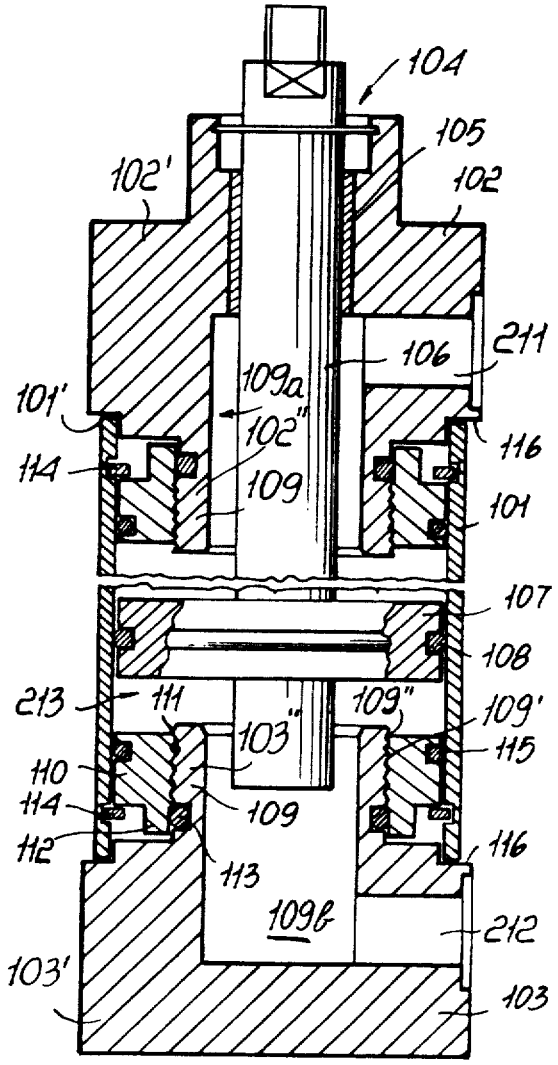
FIG. 2 is a midsectional view of a second embodiment of the invention.

In a second embodiment shown in FIG. 2, the invention still comprises a cylindrical body 101 having upper 102 and lower 103 end caps or heads. The cylinder heads 102 and 103 have a main body portion 102', 103' respectively and a hollow boss-like body portion 102", 103" respectively, coaxial with the axis of the cylinder bore.

The end cap 102 is again formed with an axial through hole 104, wherethrough a piston rod 106 is slidably passed with the interposition of a seal 105.

Rigid with the piston rod 106 is again a piston 107, which forms a seal with the inner wall of the cylindrical body 101 by means of an O-ring 108. The inner wall forms a cylinder bore space within which the piston 107 is movable.

Connection of the end caps is accomplished, in the embodiment being described, by interposing, within an annular interspace provided between the cylindrical body 101 and an inner hollow cylindrical boss-like body portion 109 in the end cap 103, a metal ring 110 having a substantially rectangular cross-sectional configuration. The cylindrical boss-like body portion 109 has an internal cavity 109*a*, 109*b* the diameter of which is greater than the diameter of the piston rod 106 and in communication with respective fluid passages 211, 212 and with the bore space 213.

Said ring 110 has an inside thread 111 for thread engagement with an external thread 109' provided on the external cylindrical surface 109" of the hollow cylindrical body 109.

The ring 110 is further formed with an additional annular lug 112 extending towards the head 103 and against the body 109 for assuring a fluid tight association by means of an O-ring seal 113 accommodated in a groove formed in the hollow cylindrical body 109.

The ring 110 is again arranged to interfere with a mechanical retainer 114 which is partly inserted in an annular groove formed in the inside portion of the cylindrical body 101.

A further O-ring seal 115, inserted into a groove formed in an external surface of the ring 110, provides a fluid tight seal along the area between the ring 110 and cylindrical body 101.

In this embodiment, a tight seal is ensured by the end caps 103 and 102 which carry the cylindrical body 101 being threaded in to abut with its annular edges 101' against a flange or shoulder formation, indicated at 116, on the end cap 103.

Connection of the upper end cap 102 is achieved in the same way as the end cap 103.

Of course the two embodiments can co-exist in a same cylinder, whereat for example the upper head is connected to the cylindrical body as shown in FIG. 1, whereas the lower head is connected to the cylindrical body as shown in FIG. 2 or viceversa.

It may be appreciated from the foregoing description that all of the invention objects have been achieved, and that both embodiments of the invention provide a fluid operated cylinder which is extremely simple, compact, and free of any outwardly protruding elements.

Of course, dimensions may be selected contingent on individual cylinder design, and the materials used may be any suitable ones.

I claim:

1. A pressure fluid operated cylinder comprising a cylinder body having a cylinder bore space therein and a cylindrical inner wall defining said cylinder bore space, a bore axis and a bore diameter, said cylindrical inner wall having an annular edge formation on at least one end thereof, a piston slidable within said bore space and having a piston rod, a cylinder head on each end of said cylinder body and arranged to close said bore, said cylinder heads having fluid passage means in communication with said bore space of the cylinder, at least one of said cylinder heads having a through hole with a diameter for an end portion of said rod and sealing means within said through hole for allowing slidable passage of said rod there-through in co-axial relationship with said bore, at least one of said cylinder heads having a main body portion with a main external diameter outside said cylinder wall and a hollow boss-like body portion projecting from said main body portion into said cylinder bore space and coaxial with said cylinder bore axis, said boss-like body portion having an external cylindrical boss surface and an external boss diameter thereof smaller than said main external diameter and smaller than said bore diameter to leave an annular interspace between said inner wall of said cylinder body and said external cylindrical boss surface, said main external diameter being greater than said bore diameter, thereby to define an annular shoulder formation at the location where said boss-like body portion joins said main body portion, said annular shoulder formation abutting against said annular edge of said cylindrical inner wall, a ring within said annular interspace and surrounding said hollow boss-like body, retainer means in said inner wall for preventing axial movement of said ring towards said main body portion beyond said retainer location, and screw thread means connecting said ring with said one cylinder head thereby to allow upon screwing tight said screw thread means said annular shoulder of said one cylinder head to be pressed against said annular edge of said cylindrical inner wall and wherein said screw thread means comprise an outer screw thread on said external cylindrical boss surface and an inner screw thread on said ring in engagement with said outer screw thread and wherein said hollow boss-like body portion has an internal cylindrical cavity with a diameter greater than a diameter of said piston rod and in communication with said bore space and said fluid passage means.

2. A pressure fluid operated cylinder comprising a cylinder body having a cylinder bore space therein and a cylindrical inner wall defining said cylinder bore space, a bore axis and a bore diameter, said cylindrical inner wall having an annular edge formation on at least one end thereof, a piston slidable within said bore space and having a piston rod, a cylinder head on each end of said cylinder body and arranged to close said bore, said cylinder heads having fluid passage means in communication with said bore space of the cylinder, at least one of said cylinder heads having a through hole with a diameter for an end portion of said rod and sealing means within said through hole for allowing slidable passage of said rod there-through in coaxial relationship with said bore, at least one of said cylinder heads having a main body portion with a main external diameter outside said cylinder wall and a hollow boss-like body portion projecting from said main body portion into said cylinder bore space and coaxial with said cylinder bore axis, said boss-like body portion having an external cylindrical boss surface and an external boss diameter thereof smaller than said main external diameter and smaller than said bore diameter to leave an annular interspace between said inner wall of said cylinder body and said external cylindrical boss surface, said main external diameter being greater than said bore diameter thereby to define an annular shoulder formation at the location where said boss-like body portion joins said main body portion, said annular shoulder formation abutting against said annular edge of said cylindrical inner wall, a ring within said annular interspace and surrounding said hollow boss-like body, retainer means in said inner wall for preventing axial movement of said ring towards said main body portion beyond said retainer location, and screw thread means connecting said ring with said one cylinder head thereby to allow upon screwing tight said screw thread means said annular shoulder of said one cylinder head to be pressed against said annular edge of said cylindrical inner wall.

3. A pressurized fluid operated cylinder according to claim 2, wherein said screw thread means comprises capscrews and a plurality of threaded holes arranged circumferentially on said ring and extending parallel to said cylinder bore axis, seats circumferentially arranged in at least one of said cylinder heads, said threaded holes being adapted for screw thread engagement with said capscrews, said capscrews having screw heads accommodated in said seats.

4. A pressurized fluid operated cylinder according to claim 1 wherein said screw thread means connecting said ring with said one cylinder head comprise an inner thread formed on said ring and an outer thread formed on said external cylindrical boss surface, said outer thread being adapted for engaging with said inner thread of said ring.

5. A device according to claim 2, wherein said screw thread means comprise an outer screw thread on said external cylindrical boss surface and an inner screw thread on said ring in engagement with said outer screw thread.

6. A device according to claim 2, wherein said hollow boss-like body portion has an internal cylindrical cavity with a diameter greater than a diameter of said piston rod and in communication with said bore space and said fluid passage means.

7. A pressurized fluid operated cylinder as claimed in claim 2 further comprising seal members including a first O-ring attached on said piston for forming a seal between said cylindrical inner wall and said piston, a first groove formed in said external cylindrical boss surface, a second O-ring accommodated in said first groove and facing said ring, said ring having an outside peripheral surface with a second groove formed therein and a third O-ring inserted into said second groove and facing said cylindrical inner wall.

* * * * *